US007163309B2

(12) United States Patent
Sohn

(10) Patent No.: US 7,163,309 B2
(45) **Date of Patent: *Jan. 16, 2007**

(54) CLIP TYPE LIGHT EMITTER

(76) Inventor: Dae Up Sohn, 204ho, 222 Dong, Mokdong Ap. 902-1, Mok-Dong, Yangcheon-Gu, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/426,022

(22) Filed: Jun. 23, 2006

(65) Prior Publication Data

US 2006/0227540 A1 Oct. 12, 2006

Related U.S. Application Data

(63) Continuation of application No. 10/758,107, filed on Jan. 16, 2004, now Pat. No. 7,118,241.

(30) Foreign Application Priority Data

Jan. 22, 2003 (KR) ..... 20-2003-0002051

(51) Int. Cl.
*F21V 21/084* (2006.01)

(52) U.S. Cl. ..... 362/106; 362/190; 362/230; 362/396; 2/906

(58) Field of Classification Search ..... 362/103, 362/105, 109, 190, 191, 230, 396, 290; 2/175.1, 2/20, 906
See application file for complete search history.

(56) References Cited

U.S. PATENT DOCUMENTS 2,524,881 A 10/1950 Chambers
D188,129 S 7/1960 Wansky
3,032,647 A 5/1962 Wansky et al.
D228,465 S 9/1973 Louis
4,298,913 A 11/1981 Lozar
4,406,040 A 9/1983 Cannone
5,357,409 A 10/1994 Glatt
5,460,346 A 10/1995 Hirsch
5,467,992 A 11/1995 Harkness
5,485,358 A 1/1996 Chien
5,541,816 A 7/1996 Miserendino
D374,731 S 10/1996 Anwyl-Davies
D376,469 S 12/1996 Harkness
5,741,060 A 4/1998 Johnson
5,911,494 A 6/1999 Lary (Continued)

*Primary Examiner*—John Anthony Ward
(74) *Attorney, Agent, or Firm*—Craig A. Fieschko, Esq.; DeWitt Ross & Stevens S.c.

(57) ABSTRACT

The present invention relates to a clip type light emitter, and in particular to a clip type light emitter capable of enhancing a visual field at night by detachably engaging a clip type light emitter to a leisure cap (including hat) generally used for a mountain climbing or fishing or travel or various sports. The clip type light emitter comprises a casing forming a body; a plurality of lamps provided at a front side of the casing at regular intervals; a switch part provided in one side of the casing; a battery provided in the interior of the casing; and a clip provided in an upper side of the casing and having one side end integrally engaged with the casing and having a certain elastic force, wherein the clip type light emitter is detachably engaged to a leisure cap (including hat) used for a mounting climbing, a fishing or various outdoor leisure and sports.

36 Claims, 2 Drawing Sheets

U.S. PATENT DOCUMENTS 5,991,494 A 11/1999 Otsuka
6,168,286 B1 1/2001 Duffy
6,206,543 B1 3/2001 Henry
6,619,813 B1 9/2003 Schnell
6,659,618 B1 12/2003 Waters
6,719,417 B1 4/2004 Hay et al.
6,719,437 B1 * 4/2004 Lary et al. ..... 362/106
6,733,150 B1 5/2004 Hanley

* cited by examiner

CLIP TYPE LIGHT EMITTER

CROSS-REFERENCE TO RELATED APPLICATIONS

This application is a continuation of U.S. patent application Ser. No. 10/758107 filed Jan. 16, 2004, now U.S. Pat. No. 7,118,241, which is incorporated by reference herein.

BACKGROUND OF THE INVENTION

1. Field of the Invention

The present invention relates to a clip type light emitter, and in particular to a clip type light emitter capable of enhancing a visual field at night by detachably engaging a clip type light emitter to a leisure cap (including hat) generally used for a mountain climbing or fishing or travel or various sports.

2. Description of the Background Art

Generally, people use a cap for protecting a face during a mountain climbing or fishing or preventing sweat falling down on the face.

In addition, a cap is commonly used during a travel or various sports for same purpose. Recently, the cap is used as a part of a fashion.

The cap is provided for various different purposes such as a fashion cap enhancing a fashion feeling, a winter cap for a cold weather, a safety cap for a safety of a worker, a cap for various sports, a leisure cap, etc.

Among the above various caps, in the case of the safety cap used for a safety when a worker works in a dark place such as a tunnel, a mine, etc., a certain lamp is installed at a front side of the cap for enhancing a visual field.

However, as shown in FIG. 1, there is not provided a certain light emitter device in the case of a leisure cap or a sports cap for a mountain climbing, a fishing, etc. except for the above safety cap. Therefore, there is additionally provided a certain lamp or flash for the people who enjoy a night climbing, a night fishing, etc. or the people who enjoys various sports at night in a place in which there are not provided any lighting devices.

In addition, when people walk in a side street in which there is not provided any streetlight, since a visual field is not fully provided, various accidents happen.

SUMMARY OF THE INVENTION

Accordingly, it is an object of the present invention to provide a clip type light emitter that overcomes the problems encountered in the conventional art.

It is another object of the present invention to provide a clip type light emitter capable of enhancing a visual field at night by detachably engaging a clip type light emitter to a leisure cap (including hat) generally used for a mountain climbing or fishing or travel or various sports.

To achieve the above objects, there is provided a clip type light emitter comprises a casing forming a body; a plurality of lamps provided at a front side of the casing at regular intervals; a switch part provided in one side of the casing; a battery provided in the interior of the casing; and a clip provided in an upper side of the casing and having one side end integrally engaged with the casing and having a certain elastic force, wherein the clip type light emitter is detachably engaged to a leisure cap (including hat) used for a mounting climbing, a fishing or various outdoor leisure and sports.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
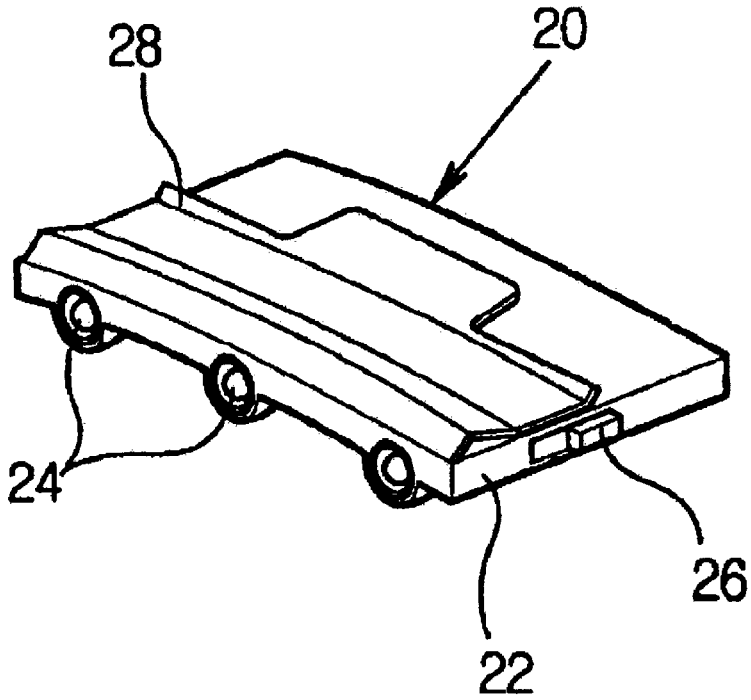
FIG. 1 is a perspective view illustrating a clip type light emitter according to the present invention.

FIG. 1 is a perspective view illustrating a clip type light emitter according to the present invention. As shown therein, in a light emitter 20, a casing 22 having a certain size forms a body. A plurality of lamps 24 are installed at a front side of the casing 22 at regular intervals. A switch part 26 is installed at one side of the casing 22. A battery (not shown) is installed in the interior of the casing 22.

In addition, a clip 28 having a certain elastic force is installed in an upper side of the casing 22 wherein the clip 28 is integrally formed with the casing.

Figure 2:
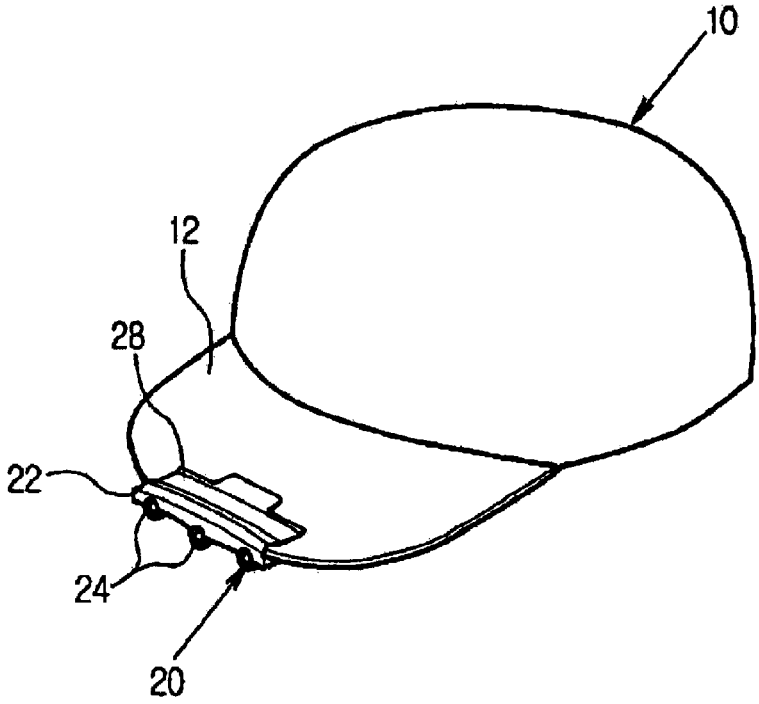
FIG. 2 is a perspective view illustrating a state that a clip type light emitter is engaged to a leisure cap according to the present invention.
Figure 3:
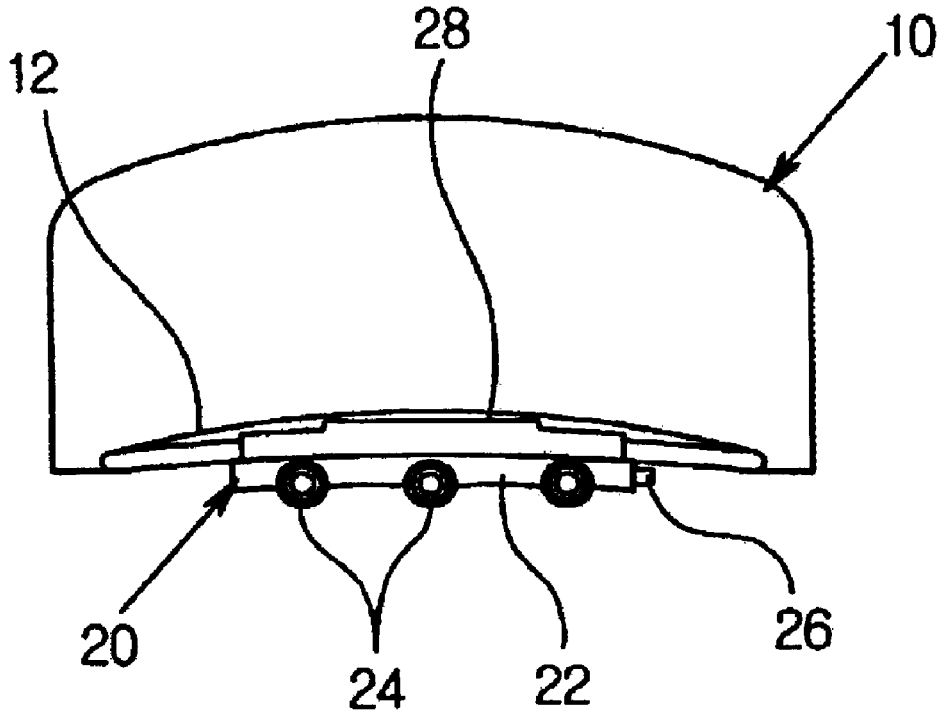
FIG. 3 is a front view illustrating the leisure cap with the clip type light emitter engaged thereto.

Therefore, as shown in FIG. 2, when the clip type light emitter 20 is engaged to a front side of a visor of a cap 20 by a one-touch method, the clip type light emitter 20 is fixed to a front side of the visor 12 of the cap 10 based on the elastic force of the clip 28.

In a state that the clip type light emitter 20 according to the present invention is engaged to the visor 12, the lamps 24 are turned on and off by operating a switch part 26 when the user of the leisure cap 10 wants to turn on light for thereby obtaining a desired visual field in the front side.

In the above description, the clip type light emitter 20 according to the present invention is provided, wherein it is detachably engaged to the visor of the leisure cap. The clip type light emitter 20 may be engaged to a curtain, etc. during a power failure at home. In addition, the clip type light emitter 20 may be fixed to a certain portion of a tent at a camping place.

As described above, according to the clip type light emitter according to the present invention, a clip type light emitter is detachably engaged to an inner side of the visor of the leisure cap based on the on and off methods. Therefore, people can obtain a desired visual field by simply wearing a cap with the clip type light emitter without providing a certain lamp or a lighting device in a place in which a certain lighting device is not provided during a night mounting climbing or a nigh fishing. In addition, people enjoying various sports at night can use the clip type light emitter according to the present invention for thereby effectively enjoying sports based on an obtained good visual field.

In addition, in the case that people walk in a side street in which a streetlight is not provided, since it is possible to obtain a desired visual field by engaging the clip type light emitter according to the present invention to his cap, the people can walk in safe.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A clip-on light comprising:

a. a casing having:

(1) a front casing side and an opposing rear casing side, with the casing having a casing depth defined between the opposing front and rear casing sides, (2) opposing top and bottom casing sides extending between the front and rear casing sides, with the casing having a casing thickness defined between the opposing top and bottom casing sides, (3) opposing left and right casing sides extending between the front and rear casing sides and also between the top and bottom casing sides, with the casing having a casing width defined between the opposing left and right casing sides, wherein the casing is substantially flat, with a casing thickness substantially smaller than the casing width and casing depth;

b. lamps located about the front casing side;

c. a switch situated on the casing, d. one or more batteries within the casing; and e. a clip provided on die casing, the clip extending from the casing and terminating in a length extending parallel to the casing, whereby an object may be situated between the clip and the casing to engage the casing to the object.

2. The clip-on light of claim 1 wherein the top casing side is gently arcuately curved to define a convex surface across the casing width, whereby the top casing side may at least substantially complementarily rest against a concave hat brim.

3. The clip-on light of claim 2 wherein the top casing side has at least four times the area of any one of the front casing side, rear casing side, left casing side, and right casing side.

4. The clip-on light of claim 3 wherein:

a. the casing depth is less than or equal to approximately 75% of the casing width; and b. the casing thickness is less than or equal to approximately 33% of the casing width.

5. The clip-on light of claim 3 wherein:

a. the casing depth is less than or equal to approximately 66% of the casing width; and b. the casing thickness is less than or equal to approximately 25% of the casing width.

6. The clip-on light of claim 1 wherein the casing thickness is less than or equal to approximately 33% of the lesser of the casing width and casing depth.

7. The clip-on light of claim 6 wherein the casing depth is less than or equal to approximately 66% of the casing width.

8. The clip-on light of claim 6 wherein the casing depth is less than or equal to approximately 75% of the casing width.

9. The clip-on light of claim 6 wherein the top casing side is gently arcuately curved to define a convex surface across the casing width.

10. The clip-on light of claim 1 wherein the casing thickness is less than or equal to approximately 20% of the lesser of the casing width and casing dept.

11. The clip-on light of claim 10 wherein the casing depth is less than or equal to approximately 66% of the easing width.

12. The clip-on light of claim 10 wherein the casing depth is less than or equal to approximately 75% of the casing width.

13. The clip-on light of claim 10 wherein the top casing side is gently arcuately curved to define a convex surface across the casing width.

14. The clip-on light of claim 1 wherein:

a. the casing depth is less than or equal to approximately 75% of the casing width; and b. the casing thickness is less than or equal to approximately 33% of the casing width.

15. The clip-on light of claim 14 wherein the top casing side is gently arcuately curved to define a convex surface across the casing width.

16. The clip-on light of claim 1 wherein:

a. the casing depth is less than or equal to approximately 66% of the casing width; and b. the casing thickness is less than or equal to approximately 25% of the casing width.

17. The clip-on light of claim 16 wherein the top casing side is gently arcuately curved to define a convex surface across the casing width.

18. The clip-on light of claim 1 wherein:

a. the clip extends from the top casing side, and b. the switch is situated on the casing off of the top casing side.

19. The clip-on light of claim 1 wherein the clip is integrally molded with the housing, and wherein the terminal length of the clip is resilently flexible whereby it may flex from its original orientation subject to elastic biasing back toward its original orientation.

20. The clip-on light of claim 1 in combination with a hat having a brim extending therefrom, wherein:

a. the hat brim is situated between the clip and the casing, and b. the casing is contoured to complementarily fit upon the brim.

21. A clip-on light comprising:

a. a casing having:

(1) a front casing side and an opposing rear casing side, with the casing having a casing depth defined between the opposing front and rear casing sides, (2) opposing top and bottom casing sides extending between the front and rear easing sides, with the easing having a casing thickness defined between the opposing top and bottom casing sides, (3) opposing left and right casing sides extending between the front and rear casing sides and also between the top and bottom casing sides, with the casing having a casing width defined between the opposing left and right casing sides, wherein the easing is both:

i. gently arcuately curved across the casing width, and ii. substantially thin, with:

A. a casing thickness substantially smaller than the casing width and casing depth, and B. top and bottom casing sides substantially larger than the front and rear casing sides and the top and bottom casing sides, whereby the casing may rest at least substantially complementarily and unobtrusively against a curved hat brim;

b. lamps located about the front casing side;

c. a switch situated on the casing;

d. one or more batteries within the casing; and e. a clip provided on the casing, the clip extending from the casing and terminating in a length extending parallel to the casing, whereby an object may be situated between the clip and the casing to engage the casing to the object.

22. A clip-on light comprising:

a. a casing having;

(1) a front casing side and an opposing rear casing side, with the casing having a casing depth defined between the opposing front and rear casing sides, (2) opposing top and bottom casing sides extending between the front and rear casing sides, with the casing having a casing thickness defined between the opposing top and bottom casing sides, (3) opposing left and right casing sides extending between the front and rear casing sides and also between the top and bottom casing sides, with the casing having a casing width defined between the opposing left and right casing sides, wherein the casing is substantially thin and flat, with:

i. the casing depth being less than or equal to approximately 75% of the casing width, ii. the casing thickness being less than or equal to approximately 33% of the casing width, and iii. the top and bottom casing sides each having at least four times the area of any one of the front casing side, rear casing side, left casing side, and right casing side; and iv. the casing width being greater than the casing depth;

b. lamps located about the front casing side;

c. a switch situated on the casing;

d. one or more batteries within the casing; and e. a clip provided on the casing, the clip extending from the casing toward the rear casing side and terminating in a length extending parallel to the casing, whereby an object may be situated between the clip and the casing to engage the casing to the object.

23. The clip-on light of claim 22 wherein:

a. the casing thickness varies along the casing width at the casing front side, whereby bulges are defined in the casing thickness along the casing front side;

b. the lamps are situated within the bulges.

24. The clip-on light of claim 22 wherein the top casing side has at least four times the area of any one of the front casing side, rear casing side, left casing side, and right casing side.

25. The clip-on light of claim 22 wherein the casing thickness is less than or equal to approximately 33% of the lesser of the casing width and casing depth.

26. The clip-on light of claim 22 wherein the casing thickness is less than or equal to approximately 20% of the lesser of the casing width and casing depth.

27. The clip-on light of claim 26 wherein the casing depth is less than or equal to approximately 66% of the casing width.

28. The clip-on light of claim 22 wherein the clip is integrally molded with the housing, and wherein the terminal length of the clip is resilently flexible whereby it may flex from its original orientation subject to elastic biasing back toward its original orientation.

29. The clip-on light of claim 1 wherein the clip extends from the casing toward the rear casing side.

30. The clip-on light of claim 1 wherein:

a. the casing width is greater than the casing depth and casing thickness; and b. the lamps are spaced across the casing width on the front casing side.

31. The clip-on light of claim 1 wherein:

a. the casing thickness varies along the casing width at the casing front side, whereby bulges are defined in die casing thickness along the casing front side; and b. the lamps are situated within the bulges.

32. The clip-on light of claim 21 wherein the clip extends from the casing toward the rear casing side.

33. The clip-on light of claim 32 wherein:

a. the casing width is greater than the casing depth and casing thickness; and b. the lamps are spaced across the casing width on the front casing side.

34. The clip-on light of claim 33 wherein:

a. the casing thickness varies along the casing width at the casing front side, whereby bulges are defined in the casing thickness along the casing front side; and b. the lamps art situated within the bulges.

35. The clip-on light of claim 34 wherein the casing thickness is less than or equal to approximately 33% of the lesser of the casing width and casing depth.

36. The clip-on light of claim 21 wherein the clip is integrally molded with the housing, and wherein the terminal length of the clip is resiliently flexible whereby it may flex from its original orientation subject to elastic biasing back toward its original orientation.

* * * * *

UNITED STATES PATENT AND TRADEMARK OFFICE

CERTIFICATE OF CORRECTION

PATENT NO. : 7,163,309 B2
APPLICATION NO. : 11/426022
DATED : January 16, 2007
INVENTOR(S) : Dae Up Sohn It is certified that error appears in the above-identified patent and that said Letters Patent is hereby corrected as shown below:

| Column | Line(s) | Delete | and | Insert |
|---|---|---|---|---|
| 3 | 29 | die | | the |
| 3 | 67 | dept | | depth |
| 4 | 2 | easing | | casing |
| 4 | 32 | resilently | | resiliently |
| 4 | 47 | easing | | casing |
| 4 | 48 | easing | | casing |
| 4 | 55 | easing | | casing |
| 6 | 39 | art | | are |

Signed and Sealed this

Third Day of July, 2007

JON W. DUDAS
*Director of the United States Patent and Trademark Office*